US008430173B2

(12) United States Patent
Todd et al.

(10) Patent No.: US 8,430,173 B2
(45) **Date of Patent: *Apr. 30, 2013**

(54) HIGH STRENGTH DISSOLVABLE STRUCTURES FOR USE IN A SUBTERRANEAN WELL

(75) Inventors: Bradley L. Todd, Duncan, OK (US); Thomas D. Welton, Duncan, OK (US); Luke W. Holderman, Plano, TX (US); Ivan Suleiman, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 242 days.

This patent is subject to a terminal disclaimer.

(21) Appl. No.: 12/758,781

(22) Filed: Apr. 12, 2010

(65) Prior Publication Data

US 2011/0247833 A1 Oct. 13, 2011

(51) Int. Cl.
*E21B 29/02* (2006.01)
*E21B 34/06* (2006.01)

(52) U.S. Cl.
USPC ..... 166/376; 166/317

(58) Field of Classification Search ..... 166/376, 166/317, 228, 229
See application file for complete search history.

(56) References Cited

U.S. PATENT DOCUMENTS

| | | | | |
|---|---|---|---|---|
| 5,479,986 | A | 1/1996 | Gano et al. | |
| 5,685,372 | A | 11/1997 | Gano | |
| 5,765,641 | A | 6/1998 | Shy et al. | |
| 6,026,903 | A | 2/2000 | Shy et al. | |
| 6,220,350 | B1 | 4/2001 | Brothers et al. | |
| 6,896,058 | B2 | 5/2005 | Munoz, Jr. et al. | |
| 7,000,680 | B2 * | 2/2006 | Kurokawa et al. | 164/528 |
| 7,093,664 | B2 | 8/2006 | Todd et al. | |
| 7,353,879 | B2 | 4/2008 | Todd et al. | |
| 7,661,481 | B2 | 2/2010 | Todd et al. | |
| 7,699,101 | B2 | 4/2010 | Fripp et al. | |
| 7,789,152 | B2 * | 9/2010 | Langeslag | 166/296 |
| 2004/0231845 | A1 | 11/2004 | Cooke, Jr. | |
| 2005/0274524 | A1 | 12/2005 | Silguero | |
| 2006/0219407 | A1 | 10/2006 | Livingstone | |
| 2006/0275563 | A1 | 12/2006 | Duffy | |
| 2006/0276345 | A1 | 12/2006 | Todd et al. | |
| 2007/0221387 | A1 | 9/2007 | Levy | |
| 2007/0277979 | A1 | 12/2007 | Todd et al. | |
| 2008/0084106 | A1 | 4/2008 | Marathe et al. | |
| 2008/0135249 | A1 | 6/2008 | Fripp et al. | |
| 2008/0149351 | A1 | 6/2008 | Marya et al. | |

(Continued)

FOREIGN PATENT DOCUMENTS

EP 0009315 A1 4/1980

OTHER PUBLICATIONS

A.C. Albertsson, "Advances in Polymer Science" vol. 157 entitled "Degradable Aliphatic Polyesters," Springer—Verlag Berlin Heidelberg publication, dated 2002.

(Continued)

*Primary Examiner* — Giovanna Wright
(74) *Attorney, Agent, or Firm* — Smith IP Services, P.C.

(57) ABSTRACT

A well tool can include a flow path, and a flow blocking device which selectively prevents flow through the flow path. The device can include an anhydrous boron compound. A method of constructing a downhole well tool can include forming a structure of a solid mass comprising an anhydrous boron compound, and incorporating the structure into the well tool.

35 Claims, 6 Drawing Sheets

U.S. PATENT DOCUMENTS

| | | | | |
|---|---|---|---|---|
| 2008/0305326 | A1 | 12/2008 | Gavel et al. | |
| 2009/0084539 | A1 | 4/2009 | Duan et al. | |
| 2009/0283271 | A1 | 11/2009 | Langeslag | |
| 2010/0089565 | A1 | 4/2010 | Duan et al. | |
| 2010/0200235 | A1* | 8/2010 | Luo et al. | 166/284 |
| 2011/0088901 | A1* | 4/2011 | Watters et al. | 166/293 |
| 2011/0247833 | A1 | 10/2011 | Todd et al. | |
| 2012/0061102 | A1 | 3/2012 | Holderman et al. | |
| 2012/0125630 | A1 | 5/2012 | Sevre | |
| 2012/0160478 | A1* | 6/2012 | Todd et al. | 166/205 |

OTHER PUBLICATIONS

International Search Report with Written Opinion issued Dec. 12, 2011 for PCT Patent Application No. PCT/US11/031242, 11 pages.
Search Report issued Dec. 12, 2011 for International Application No. PCT/US11/031242, 6 pages.
Written Opinion issued Dec. 12, 2011 for International Application No. PCT/US11/031242, 5 pages.
Specification and Drawings for U.S. Appl. No. 13/406,359, filed Feb. 27, 2012, 41 pages.
Halliburton, Luke Holderman; Activiation Screen, Defensive Publication; Dec. 14, 2009; 3 pages.
Borax; Dehybor®, Anhydrous Borax Product Profile; Undated; 3 pages.
U.S. Appl. No. 12/554,035, filed Sep. 4, 2009; 36 pages.
Halliburton, Completion Tools; Mirage® Disappearing Plug and Autofill Sub; Product Brochure H00093; Aug. 2005; 2 pages.
Halliburton U.S. Appl. No. 12/957,522, filed Dec. 1, 2010 29 pages.
Office Action issued Nov. 6, 2012 for U.S. Appl. No. 12/951,252, 26 pages.
Office Action issued Nov. 7, 2012 for U.S.Appl. No. 13/406,359, 25 pages.
Office Action issued Nov. 8, 2012 for U.S. Appl. No. 12/879,665, 23 pages.
International Search Report with Written Opinion issued Jun. 26, 2012 for PCT Patent Application No. PCT/US11/060787, 9 pages.
Office Action issued Jul. 23, 2012 for U.S. Appl. No. 13/406,359, 27 pages.
International Preliminary Report on Patentability issued Oct. 26, 2012 for US PCT Patent Application No. PCT/US11/31242, 7 pages.
Advisory Action issued Jan. 16, 2013 for U.S. Appl. No. 13/406,359, 3 pages.

* cited by examiner

HIGH STRENGTH DISSOLVABLE STRUCTURES FOR USE IN A SUBTERRANEAN WELL

BACKGROUND

This disclosure relates generally to equipment utilized and operations performed in conjunction with a subterranean well and, in an example described below, more particularly provides high strength dissolvable structures for use in a subterranean well.

It is frequently useful to actuate, or otherwise activate or change a configuration of, a well tool in a well. For example, it is beneficial to be able to open or close a valve in a well, or at least to be able to permit or prevent flow through a flow path, when desired.

The present inventors have developed methods and devices whereby high strength dissolvable structures may be used for accomplishing these purposes and others.

SUMMARY

In the disclosure below, well tools and associated methods are provided which bring advancements to the art. One example is described below in which a high strength structure formed of a solid mass comprising an anhydrous boron compound is used in a well tool. Another example is described below in which the structure comprises a flow blocking device in the well tool.

In one aspect, this disclosure provides to the art a unique well tool. The well tool can include a flow path, and a flow blocking device which selectively prevents flow through the flow path. The device includes an anhydrous boron compound.

In another aspect, a method of constructing a downhole well tool is provided by this disclosure. The method can include: forming a structure of a solid mass comprising an anhydrous boron compound; and incorporating the structure into the well tool.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
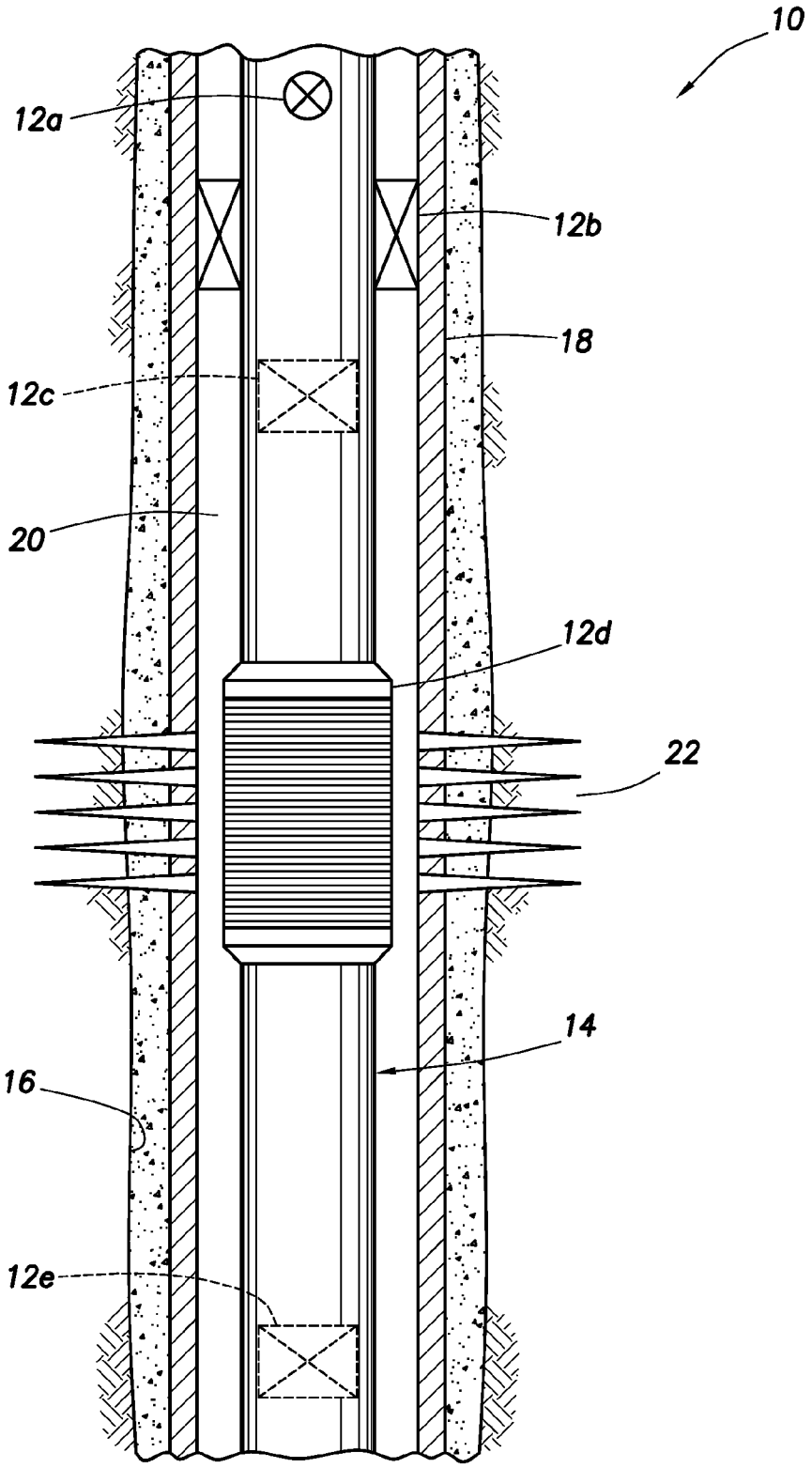
FIG. 1 is a schematic partially cross-sectional view of a well system and associated method embodying principles of the present disclosure.

Representatively illustrated in FIG. 1 is a well system 10 and associated method which embody principles of this disclosure. In the system 10, various well tools 12*a-e* are interconnected in a tubular string 14 installed in a wellbore 16. A liner or casing 18 lines the wellbore 16 and is perforated to permit fluid to be produced into the wellbore.

At this point, it should be noted that the well system 10 and associated method are merely one example of a wide variety of systems and methods which can incorporate the principles of this disclosure. In other examples, the wellbore 18 may not be cased, or if cased it may not be perforated. In further examples, the well tools 12*a-e*, or any of them, could be interconnected in the casing 18. In still further examples, other types of well tools may be used, and/or the well tools may not be interconnected in any tubular string. In other examples, fluid may not be produced into the wellbore 18, but may instead be flowed out of, or along, the wellbore. It should be clearly understood, therefore, that the principles of this disclosure are not limited at all by any of the details of the system 10, the method or the well tools 12*a-e* described herein.

The well tool 12*a* is representatively a valve which selectively permits and prevents fluid flow between an interior and an exterior of the tubular string 14. For example, the well tool 12*a* may be of the type known to those skilled in the art as a circulation valve.

The well tool 12*b* is representatively a packer which selectively isolates one portion of an annulus 20 from another portion. The annulus 20 is formed radially between the tubular string 14 and the casing 18 (or a wall of the wellbore 16 if it is uncased).

The well tool 12*c* is representatively a valve which selectively permits and prevents fluid flow through an interior longitudinal flow path of the tubular string 14. Such a valve may be used to allow pressure to be applied to the tubular string 14 above the valve in order to set the packer (well tool 12*b*), or such a valve may be used to prevent loss of fluids to a formation 22 surrounding the wellbore 16.

The well tool 12*d* is representatively a well screen assembly which filters fluid produced from the formation 22 into the tubular string 14. Such a well screen assembly can include various features including, but not limited to, valves, inflow control devices, water or gas exclusion devices, etc.

The well tool 12*e* is representatively a bridge plug which selectively prevents fluid flow through the interior longitudinal flow path of the tubular string. Such a bridge plug may be used to isolate one zone from another during completion or stimulation operations, etc.

Note that the well tools 12*a-e* are described herein as merely a few examples of different types of well tools which can benefit from the principles of this disclosure. Any other types of well tools (such as testing tools, perforating tools, completion tools, drilling tools, logging tools, treating tools, etc.) may incorporate the principles of this disclosure.

Each of the well tools 12*a-e* may be actuated, or otherwise activated or caused to change configuration, by means of a high strength dissolvable structure thereof. For example, the circulation valve well tool 12*a* could open or close in response to dissolving of a structure therein. As another example, the packer well tool 12*b* could be set or unset in response to dissolving of a structure therein.

In one unique aspect of the system 10, the high strength dissolvable structure comprises an anhydrous boron compound. Such anhydrous boron compounds include, but are not limited to, anhydrous boric oxide and anhydrous sodium borate.

Preferably, the anhydrous boron compound is initially provided as a granular material. As used herein, the term "granular" includes, but is not limited to, powdered and other fine-grained materials.

As an example, the granular material comprising the anhydrous boron compound is preferably placed in a graphite crucible, the crucible is placed in a furnace, and the material is heated to approximately 1000 degrees Celsius. The material is maintained at approximately 1000 degrees Celsius for about an hour, after which the material is allowed to slowly cool to ambient temperature with the furnace heat turned off.

As a result, the material becomes a solid mass comprising the anhydrous boron compound. This solid mass may then be readily machined, cut, abraded or otherwise formed as needed to define a final shape of the structure to be incorporated into a well tool.

Alternatively, the heated material may be molded prior to cooling (e.g., by placing the material in a mold before or after heating). After cooling, the solid mass may be in its final shape, or further shaping (e.g., by machining, cutting abrading, etc.) may be used to achieve the final shape of the structure.

Such a solid mass (and resulting structure) comprising the anhydrous boron compound will preferably have a compressive strength of about 165 MPa, a Young's modulus of about 6.09E+04 MPa, a Poisson's ratio of about 0.264, and a melting point of about 742 degrees Celsius. This compares favorably with common aluminum alloys, but the anhydrous boron compound additionally has the desirable property of being dissolvable in an aqueous fluid.

For example, a structure formed of a solid mass of an anhydrous boron compound can be dissolved in water in a matter of hours (e.g., 8-10 hours). Note that a structure formed of a solid mass can have voids therein and still be "solid" (i.e., rigid and retaining a consistent shape and volume, as opposed to a flowable material, such as a liquid, gas, granular or particulate material).

If it is desired to delay the dissolving of the structure, a barrier (such as, a glaze, coating, etc.) can be provided to delay or temporarily prevent hydrating of the structure due to exposure of the structure to aqueous fluid in the well.

One suitable coating which dissolves in aqueous fluid at a slower rate than the anhydrous boron compound is polylactic acid. A thickness of the coating can be selected to provide a predetermined delay time prior to exposure of the anhydrous boron compound to the aqueous fluid.

Other suitable degradable barriers include hydrolytically degradable materials, such as hydrolytically degradable monomers, oligomers and polymers, and/or mixtures of these. Other suitable hydrolytically degradable materials include insoluble esters that are not polymerizable. Such esters include formates, acetates, benzoate esters, phthalate esters, and the like. Blends of any of these also may be suitable.

For instance, polymer/polymer blends or monomer/polymer blends may be suitable. Such blends may be useful to affect the intrinsic degradation rate of the hydrolytically degradable material. These suitable hydrolytically degradable materials also may be blended with suitable fillers (e.g., particulate or fibrous fillers to increase modulus), if desired.

In choosing the appropriate hydrolytically degradable material, one should consider the degradation products that will result. Also, these degradation products should not adversely affect other operations or components.

The choice of hydrolytically degradable material also can depend, at least in part, on the conditions of the well, e.g., well bore temperature. For instance, lactides may be suitable for use in lower temperature wells, including those within the range of 15 to 65 degrees Celsius, and polylactides may be suitable for use in well bore temperatures above this range.

The degradability of a polymer depends at least in part on its backbone structure. The rates at which such polymers degrade are dependent on the type of repetitive unit, composition, sequence, length, molecular geometry, molecular weight, morphology (e.g., crystallinity, size of spherulites and orientation), hydrophilicity, hydrophobicity, surface area and additives. Also, the environment to which the polymer is subjected may affect how it degrades, e.g., temperature, amount of water, oxygen, microorganisms, enzymes, pH and the like.

Some suitable hydrolytically degradable monomers include lactide, lactones, glycolides, anhydrides and lactams.

Some suitable examples of hydrolytically degradable polymers that may be used include, but are not limited to, those described in the publication of Advances in Polymer Science, Vol. 157 entitled "Degradable Aliphatic Polyesters" edited by A. C. Albertsson. Specific examples include homopolymers, random, block, graft, and star- and hyper-branched aliphatic polyesters.

Such suitable polymers may be prepared by polycondensation reactions, ring-opening polymerizations, free radical polymerizations, anionic polymerizations, carbocationic polymerizations, and coordinative ring-opening polymerization for, e.g., lactones, and any other suitable process. Specific examples of suitable polymers include polysaccharides such as dextran or cellulose; chitin; chitosan; proteins; aliphatic polyesters; poly(lactides); poly(glycolides); poly(ϵ-caprolactones); poly(hydroxybutyrates); aliphatic polycarbonates; poly(orthoesters); poly(amides); poly(urethanes); poly(hydroxy ester ethers); poly(anhydrides); aliphatic polycarbonates; poly(orthoesters); poly(amino acids); poly(ethylene oxide); and polyphosphazenes.

Of these suitable polymers, aliphatic polyesters and polyanhydrides may be preferred. Of the suitable aliphatic polyesters, poly(lactide) and poly(glycolide), or copolymers of lactide and glycolide, may be preferred.

The lactide monomer exists generally in three different forms: two stereoisomers L- and D-lactide and racemic D,L-lactide (meso-lactide). The chirality of lactide units provides a means to adjust, among other things, degradation rates, as well as physical and mechanical properties.

Poly(L-lactide), for instance, is a semi-crystalline polymer with a relatively slow hydrolysis rate. This could be desirable in applications where a slower degradation of the hydrolytically degradable material is desired.

Poly(D,L-lactide) may be a more amorphous polymer with a resultant faster hydrolysis rate. This may be suitable for other applications where a more rapid degradation may be appropriate.

The stereoisomers of lactic acid may be used individually or combined. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified by blending high and low molecular weight poly(lactide) or by blending poly(lactide) with other polyesters.

Plasticizers may be present in the hydrolytically degradable materials, if desired. Suitable plasticizers include, but are not limited to, derivatives of oligomeric lactic acid, polyethylene glycol; polyethylene oxide; oligomeric lactic acid; citrate esters (such as tributyl citrate oligomers, triethyl citrate, acetyltributyl citrate, acetyltriethyl citrate); glucose monoesters; partially fatty acid esters; PEG monolaurate; triacetin; poly(ϵ-caprolactone); poly(hydroxybutyrate); glycerin-1-benzoate-2,3-dilaurate; glycerin-2-benzoate-1,3-dilaurate; starch; bis(butyl diethylene glycol)adipate; ethylphthalylethyl glycolate; glycerine diacetate monocaprylate; diacetyl monoacyl glycerol; polypropylene glycol (and epoxy, derivatives thereof); poly(propylene glycol)dibenzoate, dipropylene glycol dibenzoate; glycerol; ethyl phthalyl ethyl glycolate; poly(ethylene adipate)distearate; di-iso-butyl adipate; and combinations thereof.

The physical properties of hydrolytically degradable polymers depend on several factors such as the composition of the repeat units, flexibility of the chain, presence of polar groups, molecular mass, degree of branching, crystallinity, orientation, etc. For example, short chain branches reduce the degree of crystallinity of polymers while long chain branches lower the melt viscosity and impart, among other things, elongational viscosity with tension-stiffening behavior.

The properties of the material utilized can be further tailored by blending, and copolymerizing it with another polymer, or by a change in the macromolecular architecture (e.g., hyper-branched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains.

For example, poly(phenyllactide) will degrade at about ⅕th of the rate of racemic poly(lactide) at a pH of 7.4 at 55 degrees C. One of ordinary skill in the art with the benefit of this disclosure will be able to determine the appropriate functional groups to introduce to the polymer chains to achieve the desired physical properties of the degradable polymers.

Polyanhydrides are another type of particularly suitable degradable polymer. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

An epoxy or other type of barrier which does not dissolve in aqueous fluid may be used to completely prevent exposure of the anhydrous boron compound to the aqueous fluid until the barrier is breached, broken or otherwise circumvented, whether this is done intentionally (for example, to set a packer when it is appropriately positioned in the well, or to open a circulation valve upon completion of a formation testing operation, etc.) or as a result of an unexpected or inadvertent circumstance (for example, to close a valve in an emergency situation and thereby prevent escape of fluid, etc.).

Figure 2B:
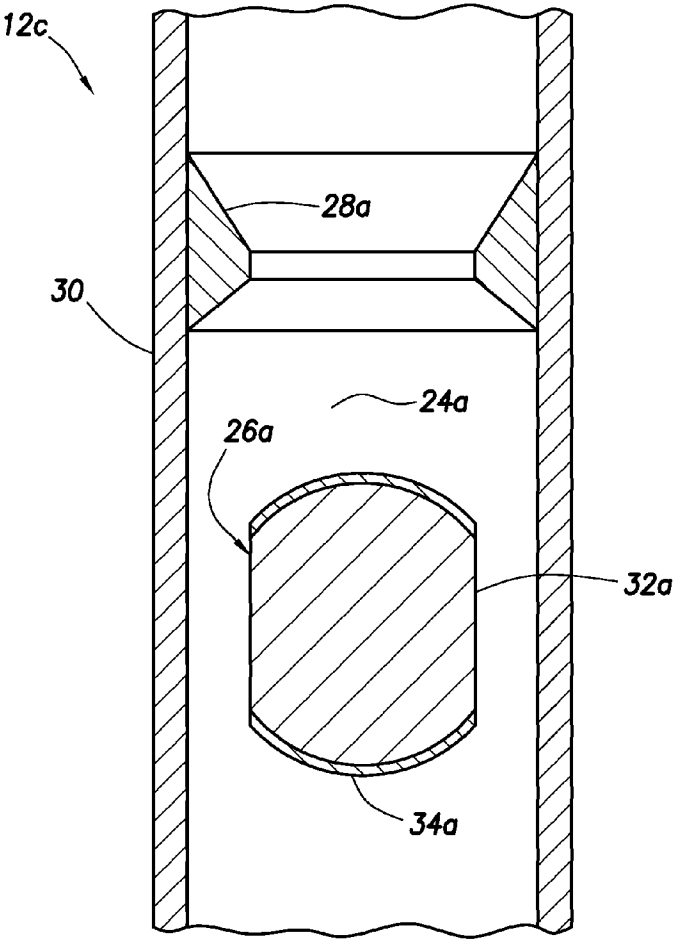
FIGS. 2A & B are enlarged scale schematic cross-sectional views of a well tool which may be used in the system and method of FIG. 1, the well tool blocking flow through a flow path in FIG. 2A, and permitting flow through the flow path in FIG. 2B.
Figure 2A:
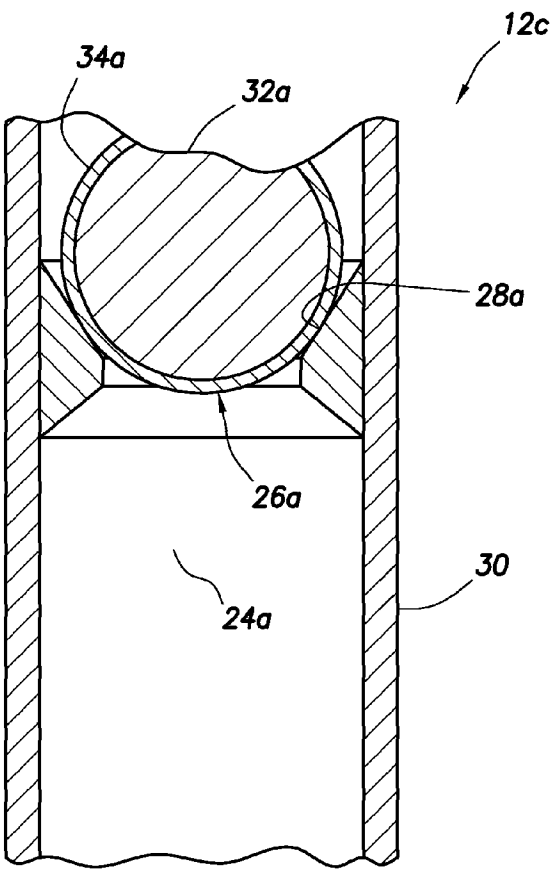

Referring additionally now to FIGS. 2A & B, the well tool 12*c* is representatively illustrated in respective flow preventing and flow permitting configurations. The well tool 12*c* may be used in the system 10 and method described above, or the well tool may be used in any other system or method in keeping with the principles of this disclosure.

In the configuration of FIG. 2A, the well tool 12*c* prevents downward fluid flow, but permits upward fluid flow, through a flow path 24*a* which may extend longitudinally through the well tool and the tubular string 14 in which the well tool is interconnected. In the configuration of FIG. 2B, the well tool 12*c* permits fluid flow in both directions through the flow path 24*a*.

The well tool 12*c* preferably includes a structure 26*a* in the form of a ball which sealingly engages a seat 28 in a housing 30. The housing 30 may be provided with suitable threads, etc. for interconnection of the housing in the tubular string 14. The structure 26*a* may be installed in the well tool 12*c* before or after the tubular string 14 is installed in the well.

The structure 26*a* comprises an anhydrous boron compound 32*a* with a barrier 34*a* thereon. The anhydrous boron compound 32*a* may be formed of a solid mass as described above. The barrier 34*a* preferably comprises a coating which prevents exposure of the anhydrous boron compound 32*a* to an aqueous fluid in the well, until the barrier is compromised.

With the structure 26*a* sealingly engaged with the seat 28 as depicted in FIG. 2A, a pressure differential may be applied from above to below the structure. In this manner, pressure may be applied to the tubular string 14, for example, to set a packer, actuate a valve, operate any other well tool, etc. As another example, the sealing engagement of the structure 26*a* with the seat 28 can prevent loss of fluid from the tubular string 14, etc.

When it is desired to permit downward flow through the flow path 24*a*, or to provide access through the well tool 12*c*, a predetermined elevated pressure differential may be applied from above to below the structure 26*a*, thereby forcing the structure through the seat 28, as depicted in FIG. 2B. This causes the barrier 34*a* to be compromised, thereby exposing the anhydrous boron compound 32*a* to aqueous fluid in the well. As a result, the anhydrous boron compound 32*a* will eventually dissolve, thereby avoiding the possibility of the structure 26*a* obstructing or otherwise impeding future operations.

Note that the barrier 34*a* could be made of a material, such as a coating, which dissolves at a slower rate than the anhydrous boron compound 32*a*, in order to delay exposure of the anhydrous boron compound to the aqueous fluid.

Figure 3:
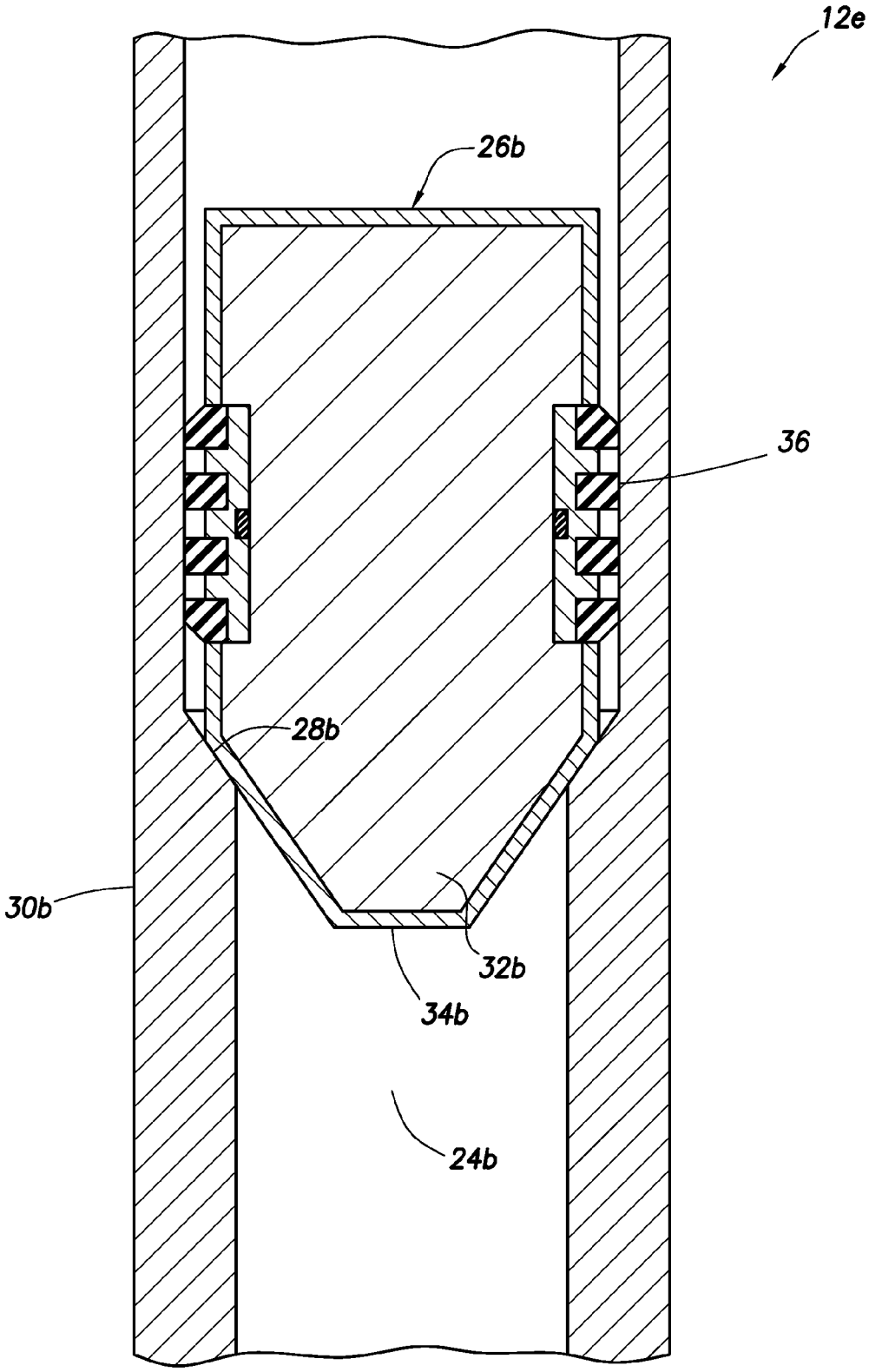
FIG. 3 is a schematic cross-sectional view of another well tool which may be used in the system and method of FIG. 1.

Referring additionally now to FIG. 3, a cross-sectional view of the well tool 12*e* is representatively illustrated. The well tool 12*e* is similar in some respects to the well tool 12*c* described above, in that the well tool 12*e* includes a structure 26*b* which selectively prevents fluid flow through a flow path 24*b*.

However, the structure 26*b* includes a barrier 34*b* which isolates an anhydrous boron compound 32*b* from exposure to an aqueous fluid in the well, until the barrier 34*b* dissolves. Thus, the structure 26*b* blocks flow through the flow path 24*b* (in both directions) for a predetermined period of time, after which the structure dissolves and thereby permits fluid flow through the flow path.

After the structure 26*b* dissolves, the only remaining components left in the housing 30*b* are seals and/or slips 36 which may be used to sealingly engage and secure the structure in the housing. The seals and/or slips 36 preferably do not significantly obstruct the flow path 24*b* after the structure 26*b* is dissolved.

Instead of using separate seals, the structure 26*b* could sealing engage a seat 28*b* in the housing 30*b*, if desired.

Figure 4B:
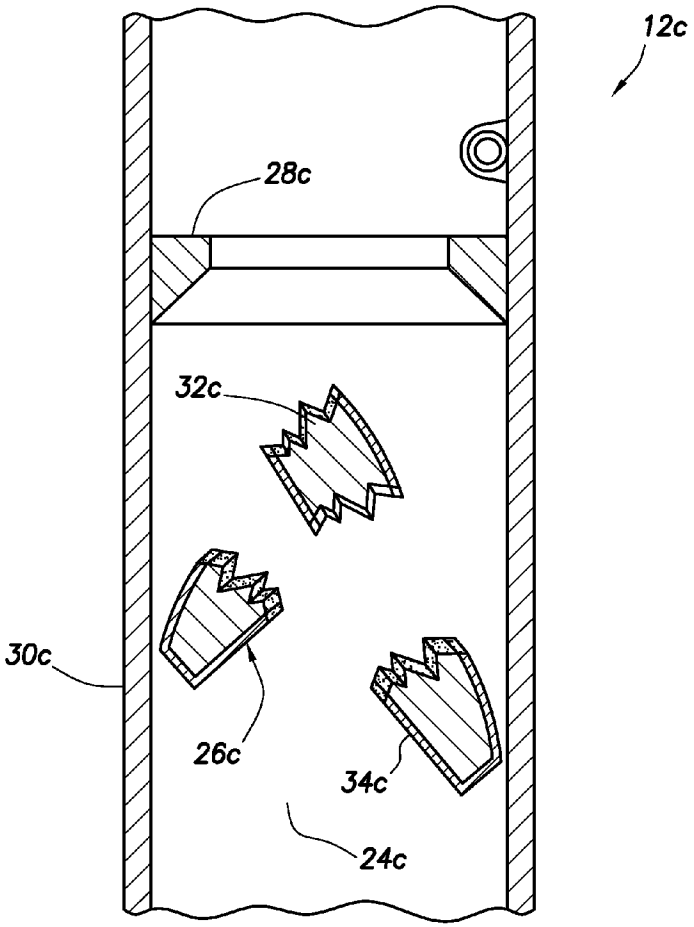
FIGS. 4A & B are enlarged scale schematic cross-sectional views of another well tool which may be used in the system and method of FIG. 1, the well tool blocking flow through a flow path in FIG. 4A, and permitting flow through the flow path in FIG. 4B.
Figure 4A:
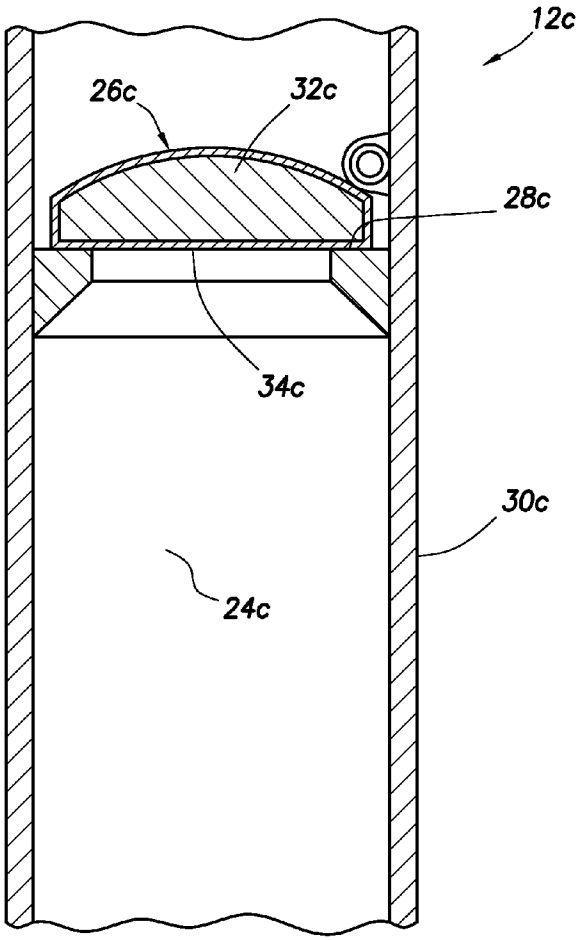

Referring additionally now to FIGS. 4A & B, another construction of the well tool 12*c* is representatively illustrated. In FIG. 4A, the well tool 12*c* is depicted in a configuration in which downward flow through the flow path 24*c* is prevented, but upward flow through the flow path is permitted. In FIG. 4B, the well tool 12*c* is depicted in a configuration in which both upward and downward flow through the flow path 24*c* are permitted.

One significant difference between the well tool 12*c* as depicted in FIGS. 4A & B, and the well tool 12*c* as depicted in FIGS. 2A & B, is that the structure 26*c* of FIGS. 4A & B is in the form of a flapper which sealingly engages a seat 28*c*. The flapper is pivotably mounted in the housing 30*c*.

Similar to the structure 26*a* described above, the structure 26*c* includes an anhydrous boron compound 32*c* and a barrier 34*c* which prevents exposure of the anhydrous boron compound to aqueous fluid in the well. When it is desired to permit fluid flow in both directions through the flow path 24*c*, the structure 26*c* is broken, thereby compromising the barrier 34*c* and permitting exposure of the anhydrous boron compound 32*c* to the aqueous fluid.

Preferably, the structure 26*c* is frangible, so that it may be conveniently broken, for example, by applying a predetermined pressure differential across the structure, or by striking the structure with another component, etc. Below the predetermined pressure differential, the structure 26*c* can resist pressure differentials to thereby prevent downward flow through the flow path 24*c* (for example, to prevent fluid loss to the formation 22, to enable pressure to be applied to the tubular string 14 to set a packer, operate a valve or other well tool, etc.).

After the anhydrous boron compound 32*c* is exposed to the aqueous fluid in the well, it eventually dissolves. In this manner, no debris remains to obstruct the flow path 24*c*.

Note that the barrier 34*c* could be made of a material, such as a coating, which dissolves at a slower rate than the anhydrous boron compound 32*c*, in order to delay exposure of the anhydrous boron compound to the aqueous fluid.

Figure 5:
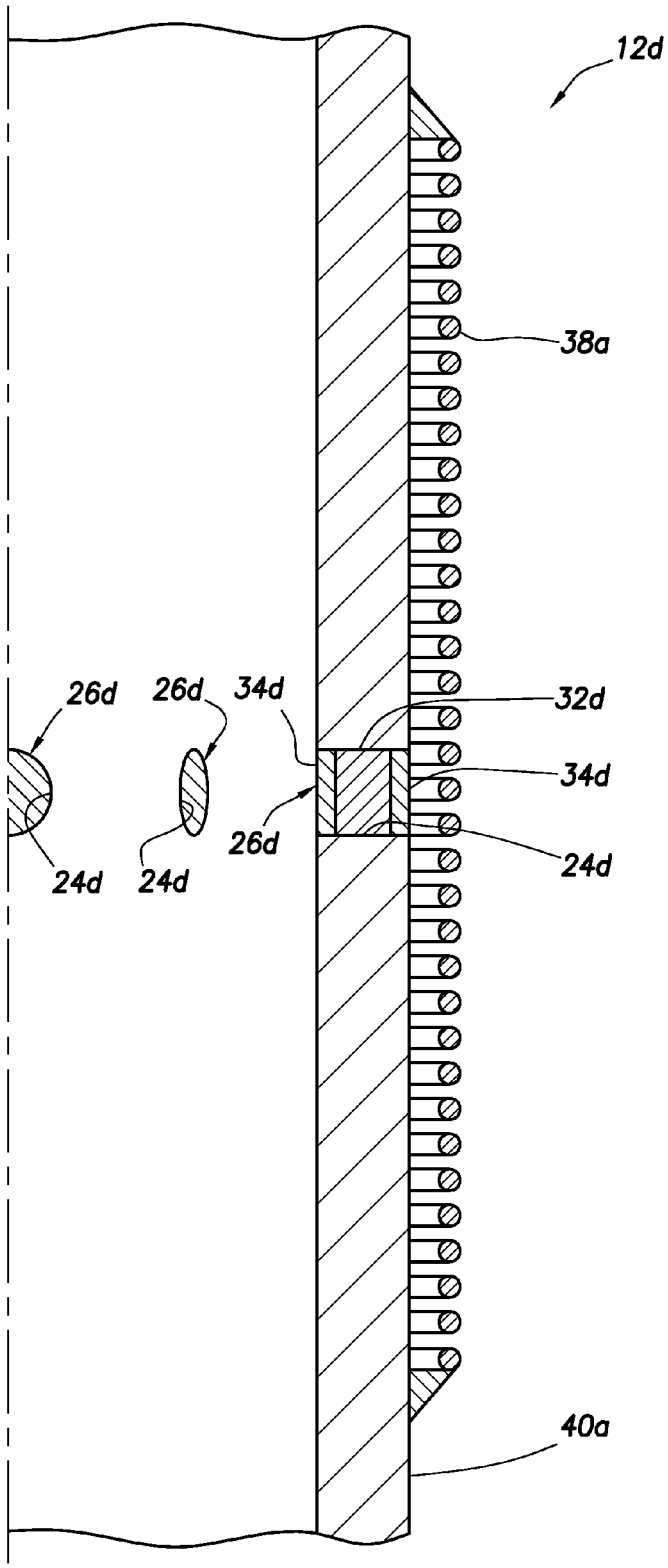
FIG. 5 is a schematic cross-sectional view of another well tool which may be used in the system and method of FIG. 1.

Referring additionally now to FIG. 5, a schematic cross-sectional view of the well tool 12*d* is representatively illustrated. The well tool 12*d* comprises a well screen assembly which includes a filter portion 38*a* overlying a base pipe 40*a*. The base pipe 40*a* may be provided with suitable threads, etc. for interconnection in the tubular string 14.

The filter portion 38*a* excludes sand, fines, debris, etc. from fluid which flows inward through the well screen assembly and into the interior of the base pipe 40*a* and tubular string 14. However, when the well screen assembly is initially installed in the well, a structure 26*d* prevents fluid flow between the interior and the exterior of the base pipe 40*a*.

By preventing fluid flow through the well screen assembly, clogging of the filter portion 38*a* can be avoided and fluid can be circulated through the tubular string 14 during installation. In this manner, use of a washpipe in the well screen assembly can be eliminated, thereby providing for a more economical completion operation.

After a predetermined period of time (e.g., after installation of the well tool 12*d*, after a completion operation, after gravel packing, etc.), a barrier 34*d* dissolves and permits exposure of an anhydrous boron compound 32*d* to an aqueous fluid in the well. The anhydrous boron compound 32*d* eventually dissolves, thereby permitting fluid flow through a flow path 24*d*. Thereafter, relatively unimpeded flow of fluid is permitted through the filter portion 38*a* and the flow path 24*d* between the exterior and the interior of the well screen assembly.

Figure 6:
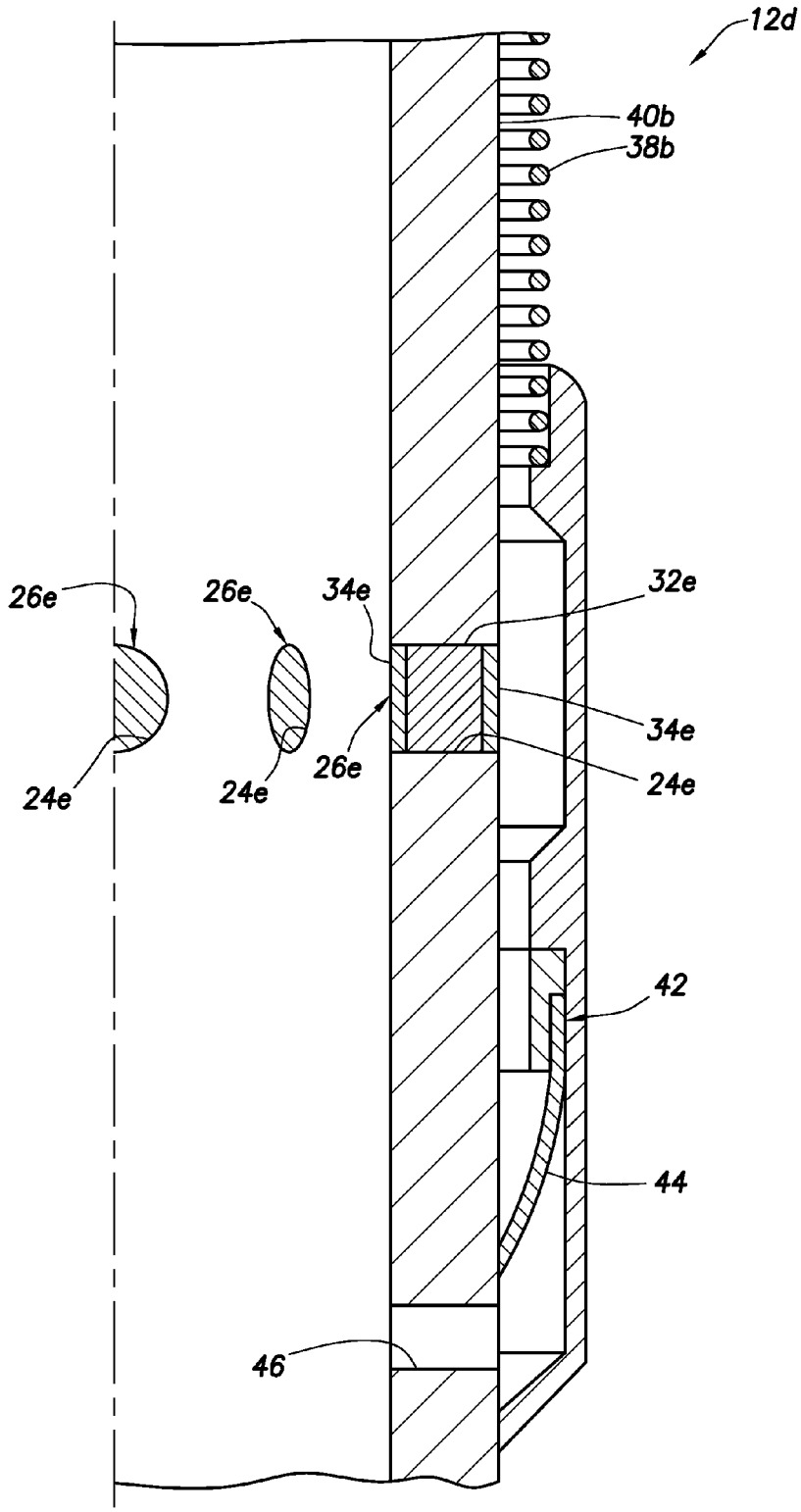
FIG. 6 is a schematic cross-sectional view of another configuration of the well tool of FIG. 5.

Referring additionally now to FIG. 6, another construction of the well tool 12*d* is representatively illustrated. The well tool 12*d* depicted in FIG. 6 is similar in many respects to the well tool depicted in FIG. 5. However, the well tool 12*d* of FIG. 6 also includes a check valve 42 which permits inward flow of fluid through the well screen assembly, but prevents outward flow of fluid through the well screen assembly.

The check valve 42 includes a flexible closure device 44 which seals against the base pipe 40*b* to prevent outward flow of fluid through the filter portion 38*b*. This allows fluid to be circulated through the tubular string 14 during installation (without the fluid flowing outward through the filter portion 38*b*), but also allows fluid to subsequently be produced inward through the well screen assembly (i.e., inward through the filter portion and check valve 42). A flow path 46 permits fluid flowing inward through the check valve 42 to flow into the interior of the base pipe 40*b* (and, thus, into the tubular string 14).

After a predetermined period of time (e.g., after installation of the well tool 12*d*, after a completion operation, after gravel packing, etc.), a barrier 34*e* dissolves and permits exposure of an anhydrous boron compound 32*e* to an aqueous fluid in the well. The anhydrous boron compound 32*e* eventually dissolves, thereby permitting fluid flow through a flow path 24*e*. Thereafter, relatively unimpeded flow of fluid is permitted through the filter portion 38*b* and the flow path 24*e* between the exterior and the interior of the well screen assembly.

In this manner, the check valve 42 is bypassed by the fluid flowing through the flow path 24*e*. That is, fluid which flows inward through the filter portion 38*b* does not have to flow through the check valve 42 into the base pipe 40*b*. Instead, the fluid can flow relatively unimpeded through the flow path 24*e* after the structure 26*e* has dissolved.

Note that the structure 26*a-e* in each of the well tools described above comprises a flow blocking device which at least temporarily blocks flow through a flow path 24*a-e*. However, it should be clearly understood that it is not necessary for a structure embodying principles of this disclosure to comprise a flow blocking device.

Furthermore, the structure 26*a-e* in each of the well tools described above can be considered a closure device in a valve of the well tool. Thus, the structure 26*a-e* in each of the well tools initially prevents flow in at least one direction through a flow path, but can selectively permit flow through the flow path when desired.

One advantage of using the anhydrous boron compound 32*a-e* in the structures 26*a-e* can be that the anhydrous boron compound, having a relatively high melting point of about 742 degrees Celsius, can be positioned adjacent a structure which is welded and then stress-relieved. For example, in the well tool 12*d* configurations of FIGS. 5 & 6, the filter portion 38*a,b* or housing of the check valve 42 may be welded to the base pipe 40*a,b* and then stress-relieved (e.g., by heat treating), without melting the anhydrous boron compound 32*a-e*.

It may now be fully appreciated that the above disclosure provides significant improvements to the art of constructing well tools for use in subterranean wells. In particular, use of the anhydrous boron compound permits convenient, reliable and economical actuation and operation of well tools.

Those skilled in the art will recognize that the above disclosure provides to the art a method of constructing a downhole well tool 12*a-e*. The method can include forming a structure 26*a-e* of a solid mass comprising an anhydrous boron compound 32*a-e*; and incorporating the structure 26*a-e* into the well tool 12*a-e*.

Forming the structure 26*a-e* can include at least one of molding, machining, abrading and cutting the solid mass.

The structure 26*a-e* can comprise a flow blocking device, and the incorporating step can include blocking a flow path 24*a-e* in the well tool 12*a-e* with the structure 26*a-e*.

The anhydrous boron compound 32*a-e* may comprise at least one of anhydrous boric oxide and anhydrous sodium borate.

The method can include the step of providing a barrier 34*a-e* which at least temporarily prevents the anhydrous boron compound 32*a-e* from hydrating. The barrier 34*a-e* may comprise a coating, and may comprise polylactic acid.

The barrier 34*a-e* may dissolve in an aqueous fluid at a rate slower than a rate at which the anhydrous boron compound 32*a-e* dissolves in the aqueous fluid. The barrier 34*a-e* may be insoluble in an aqueous fluid.

The barrier 34*a-e* can prevent hydrating of the anhydrous boron compound 32*a-e* until after the well tool 12*a-e* is installed in a wellbore 16. A pressure differential may be applied across the structure 26*a-e* prior to the barrier 34*a-e* permitting the anhydrous boron compound 32*a-e* to hydrate.

The structure 26*a-e* may selectively permit fluid communication between an interior and an exterior of a tubular string 14.

The structure 26*a-e* may selectively block fluid which flows through a filter portion 38*a,b* of a well screen assembly.

The well tool 12*d* may comprise a well screen assembly which includes a check valve 42, with the check valve preventing flow outward through the well screen assembly and permitting flow inward through the well screen assembly. Flow inward and outward through the well screen assembly may be permitted when the anhydrous boron compound 32*d,e* dissolves.

The structure 26*a-c* can selectively block a flow path 24*a-c* which extends longitudinally through a tubular string 14.

The structure 26*a-e* may comprise a closure device of a valve. The closure device may comprise a flapper (e.g., structure 26*c*) or a ball (e.g., structure 26*a*), and the closure device may be frangible (e.g., structures 26*a,c*). The anhydrous boron compound 32*a,c* can hydrate in response to breakage of the closure device.

The method may include forming the solid mass by heating a granular material comprising the anhydrous boron compound 32*a-e*, and then cooling the material. The granular material may comprise a powdered material.

Also provided by the above disclosure is a well tool 12*a-e* which can include a flow path 24*a-e*, and a flow blocking device (e.g., structures 26*a-e*) which selectively prevents flow through the flow path. The device may include an anhydrous boron compound 32*a-e*.

The flow blocking device may be positioned adjacent a welded and stress-relieved structure.

The anhydrous boron compound 32*a-e* may comprise a solid mass formed from a granular material.

In a specific example described above, a method of constructing a downhole well tool 12*a-e* includes forming a frangible structure 26*a-e*, the frangible structure comprising a solid mass including an anhydrous boron compound; and incorporating the frangible structure 26*a-e* into a valve of the well tool 12*a-e*.

In another specific example described above, a well screen assembly (well tool 12*d*) includes a filter portion 38, a flow path 24*e* arranged so that fluid which flows through the flow path also flows through the filter portion 38, and a flow blocking device (structure 26*e*) which selectively prevents flow through the flow path 24*e*, the device including an anhydrous boron compound 32*e*.

In other specific examples described above, a well tool 12*d* includes a flow path 24*d,e* which provides fluid communication between an interior and an exterior of a tubular string 14, and a flow blocking device (structure 26*d,e*) which selectively prevents flow through the flow path 24*d,e*. The flow blocking device includes an anhydrous boron compound 32*d,e*.

Another example described above comprises a well tool 12*c* which includes a flow path 24*c* and a flapper (structure 26*c*) which selectively prevents flow through the flow path. The flapper includes an anhydrous boron compound 32*c*.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of constructing a downhole well tool, the method comprising:

forming a structure of a solid mass comprising an anhydrous boron compound;

providing a barrier which at least temporarily prevents the anhydrous boron compound from hydrating;

forming a housing which supports the structure in the well tool;

incorporating the structure into the well tool; and then positioning the housing in a wellbore.

2. The method of claim 1, wherein the barrier comprises a coating.

3. The method of claim 1, wherein the barrier comprises polylactic acid.

4. The method of claim 1, wherein the barrier is insoluble in an aqueous fluid.

5. The method of claim 1, wherein the barrier prevents hydrating of the anhydrous boron compound until after the well tool is installed in the wellbore.

6. The method of claim 1, wherein a pressure differential is applied across the structure prior to the barrier permitting the anhydrous boron compound to hydrate.

7. The method of claim 1, wherein the barrier dissolves in an aqueous fluid at a rate slower than a rate at which the anhydrous boron compound dissolves in the aqueous fluid.

8. A method of constructing a downhole well tool, the method comprising:

forming a structure of a solid mass comprising an anhydrous boron compound;

incorporating the structure into the well tool, wherein the structure comprises a closure device of a valve; and then positioning the well tool in a wellbore.

9. The method of claim 8, wherein the closure device comprises a flapper.

10. The method of claim 8, wherein the closure device comprises a ball.

11. A method of constructing a downhole well tool, the method comprising:

forming a structure of a solid mass comprising an anhydrous boron compound; and incorporating the structure into the well tool, wherein the structure comprises a closure device of a valve, wherein the closure device is frangible.

12. The method of claim 11, wherein the anhydrous boron compound hydrates in response to breakage of the closure device.

13. A method of constructing a downhole well tool, the method comprising:

forming a structure of a solid mass comprising an anhydrous boron compound;

incorporating the structure into the well tool prior to positioning the well tool in a wellbore; and forming the solid mass by heating a granular material comprising the anhydrous boron compound, and then cooling the material.

14. The method of claim 13, wherein the granular material comprises a powdered material.

15. A well tool, comprising:

a flow path which is formed in the well tool prior to positioning the well tool in a wellbore;

a flow blocking device which selectively prevents flow through the flow path, the device including an anhydrous boron compound; and a barrier which at least temporarily prevents the anhydrous boron compound from hydrating.

16. The well tool of claim 15, wherein the barrier comprises a coating.

17. The well tool of claim 15, wherein the barrier comprises polylactic acid.

18. The well tool of claim 15, wherein the barrier is insoluble in an aqueous fluid.

19. The well tool of claim 15, wherein the barrier prevents hydrating of the anhydrous boron compound until after the flow path is installed in the wellbore.

20. The well tool of claim 15, wherein a pressure differential is applied across the flow blocking device prior to the barrier permitting the anhydrous boron compound to hydrate.

21. The well tool of claim 15, wherein the barrier dissolves in an aqueous fluid at a rate slower than a rate at which the anhydrous boron compound dissolves in the aqueous fluid.

22. A well tool, comprising:

a well screen assembly;

a flow path; and a flow blocking device which selectively prevents flow through the flow path, the device including an anhydrous boron compound, wherein fluid which flows through the flow path also flows through a filter portion of the well screen assembly, and wherein a barrier at least temporarily prevents the anhydrous boron compound from hydrating until after the well screen assembly is installed in a wellbore.

23. A well tool, comprising:

a flow path; and a flow blocking device which selectively prevents flow through the flow path, the device including an anhydrous boron compound, wherein the well tool comprises a valve, and wherein the flow blocking device comprises a closure device of the valve.

24. The well tool of claim 23, wherein the closure device comprises a flapper.

25. The well tool of claim 23, wherein the closure device comprises a ball.

26. The well tool of claim 23, wherein the closure device prevents flow in a first direction through the flow path, and the closure device permits flow through the flow path in a second direction opposite to the first direction.

27. The well tool of claim 23, wherein the closure device is frangible.

28. The well tool of claim 27, wherein the anhydrous boron compound hydrates in response to breakage of the closure device.

29. The well tool of claim 23, further comprising a barrier which at least temporarily prevents the anhydrous boron compound from hydrating.

30. The well tool of claim 29, wherein the barrier comprises a coating.

31. The well tool of claim 29, wherein the barrier dissolves in an aqueous fluid at a rate slower than a rate at which the anhydrous boron compound dissolves in the aqueous fluid.

32. The well tool of claim 29, wherein the barrier is insoluble in an aqueous fluid.

33. The well tool of claim 29, wherein a pressure differential is applied across the flow blocking device prior to the barrier permitting the anhydrous boron compound to hydrate.

34. A well tool, comprising:

a flow path; and a flow blocking device which selectively prevents flow through the flow path, the device including an anhydrous boron compound, wherein the flow blocking device is positioned adjacent a welded and stress-relieved structure.

35. A well tool, comprising:

a flow path which is formed in the well tool prior to positioning the well tool in a wellbore; and a flow blocking device which selectively prevents flow through the flow path, the device including an anhydrous boron compound, wherein the anhydrous boron compound comprises a solid mass formed from a granular material.

* * * * *